United States Patent [19]

Claycomb

[11] Patent Number: 4,734,893

[45] Date of Patent: Mar. 29, 1988

[54] APPARATUS AND METHOD FOR TRANSMITTING DOWNHOLE CONDITIONS TO THE SURFACE

[75] Inventor: Jack R. Claycomb, Houston, Tex.

[73] Assignee: Navigator MWD, Inc., Houston, Tex.

[21] Appl. No.: 915,630

[22] Filed: Oct. 6, 1986

[51] Int. Cl.[4] ..... H04H 9/00; G01V 1/00

[52] U.S. Cl. ..... 367/85; 340/861; 175/40

[58] Field of Search ..... 181/102, 103, 104, 105, 181/106; 367/81, 82, 83, 84, 85, 86, 911, 912; 340/853, 860, 861; 175/45, 40, 48, 50; 166/65.1, 66, 113

[56] References Cited

U.S. PATENT DOCUMENTS

| | | | |
|---|---|---|---|
| 3,908,453 | 9/1975 | Jeter | 73/151 |
| 4,120,097 | 10/1978 | Jeter | 33/307 |
| 4,184,545 | 1/1980 | Claycomb | 166/113 |
| 4,216,590 | 8/1980 | Kelly | 33/304 |
| 4,224,687 | 9/1980 | Claycomb | 367/83 |
| 4,235,021 | 11/1980 | Claycomb | 33/307 |
| 4,262,343 | 4/1981 | Claycomb | 367/83 |
| 4,266,606 | 5/1981 | Stone | 367/85 |
| 4,371,958 | 2/1983 | Claycomb | 367/85 |
| 4,454,598 | 6/1984 | Claycomb | 367/83 |
| 4,520,468 | 5/1985 | Scherbatskoy | 367/83 |
| 4,535,429 | 8/1985 | Russell et al. | 367/85 |
| 4,550,392 | 10/1985 | Mumby | 367/82 |

*Primary Examiner*—Deborah L. Kyle
*Assistant Examiner*—Brian S. Steinberger
*Attorney, Agent, or Firm*—Gunn, Lee & Jackson

[57] ABSTRACT

A measuring while drilling tool is disclosed. The preferred embodiment incorporates an outer tubular member adapted to be connected in a drill string above the drill bit. The apparatus utilizes a mud pulser sub extending through the hollow tubular member and anchored in the drill string. The apparatus includes a sensor module and a battery module operatively connected to form a single tool. The apparatus utilizes mud flow pressure in the drill string to move a mud pulser sub through constriction rings for creating a sequence of mud pulses detectable by surface located receiving means.

6 Claims, 15 Drawing Figures

APPARATUS AND METHOD FOR TRANSMITTING DOWNHOLE CONDITIONS TO THE SURFACE

BACKGROUND OF THE DISCLOSURE

The present invention relates to an apparatus and method of measuring one or more downhole conditions in a well bore, particularly, a battery-powered, positive-pulse-telemetry system for directional survey and steering applications.

In rotary drilling operations, it is very common to measure one or more downhole conditions as drilling progresses. Consequently, various types of directional drilling systems have been developed. Typically, these systems are of the mud-pulse telemetry type for transmitting measurement data to receiving equipment located on the surface. For example, it is quite common to check the inclination and orientation of a well bore. Inclination is the deviation of the well bore from a vertical direction. Orientation refers to the relative rotation of the tool with respect to a selected side of the tool. In addition, it is very common to check the azimuthal direction of the well bore as drilling progresses. Inclination or drift typically has a range of 0 to 90.0 degrees maximum, while tool face orientation and azimuth both have a maximum range of 360.0 degrees.

These variables are measured, encoded and transmitted to the surface via the mud stream. This is accomplished by modulating the mud pressure and sensing the resultant mud pulses at the surface. Various pressure transducers are available for detecting pressure variations in the mud flow at the surface.

It is, therefore, an object of the present invention to provide an improved measuring while drilling system incorporating a battery-powered, positive-pulse-telemetry system.

SUMMARY OF THE INVENTION

The present invention is a measuring while drilling tool which is installed in the drill string. It is located in the drill string near the drill bit and includes conventional pin and box connections. The tool consists of three modules; a mud pulser sub, the electronics module, and the battery module. The assembled tool is located inside a standard non-magnetic collar. The tool includes an axial passage extending therethrough for delivery of drilling mud to the drill bit. The apparatus of the invention includes an elongate plunger located in the mud flow path which is responsive to pressure of the drilling mud. The plunger is forced downwardly in response to pump pressure on the mud, and its downward movement actuates a pair of switches to engage the system for measuring the variables of interest. The plunger passes through a series of constriction rings to form the pressure pulses. Downward movement of the plunger charges a hydraulic system which is solenoid operated to control the duration of the pressure pulses for the encoded signal of interest. The duration of the pressure pulses are displayed at the surface equipment enabling a direct reading of the variable of interest.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are, therefore, not to be considered limiting of its scope, for the invention may admit to other equally effective embodiments.

FIGS. 1A–1I, are a detailed, length-wise, sectional view showing the components of the present invention;

DETAILED DESCRIPTION OF THE PREFERRED EMBODIMENT

Figure 1A:
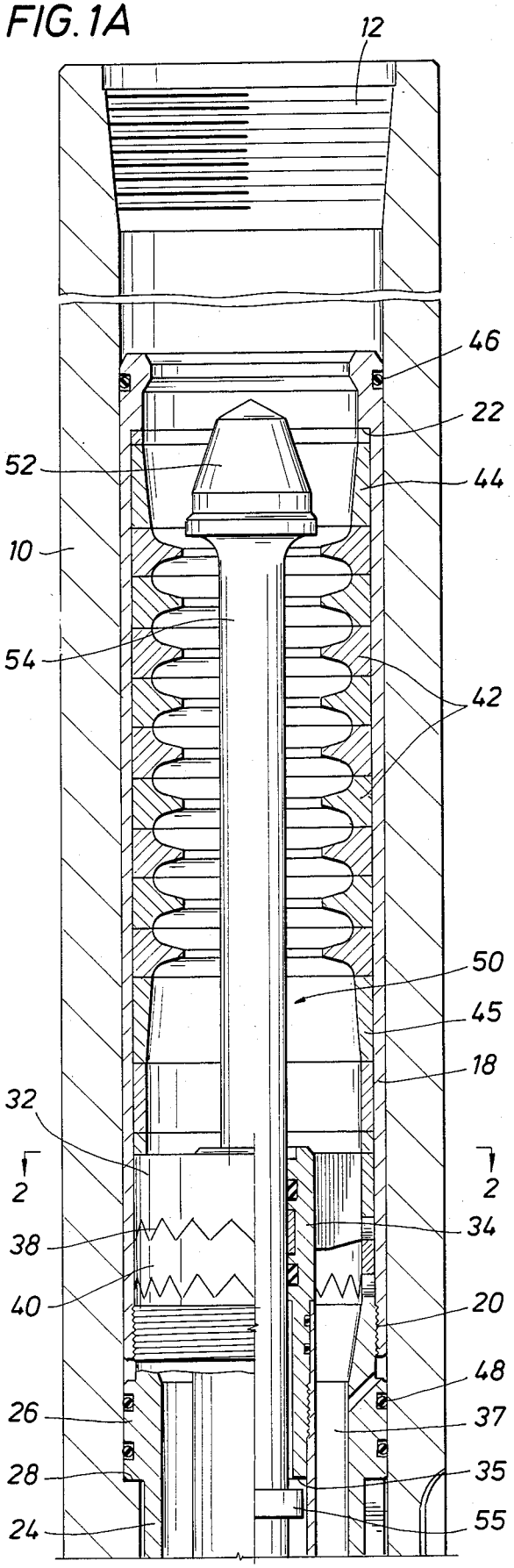
Figure 1B:
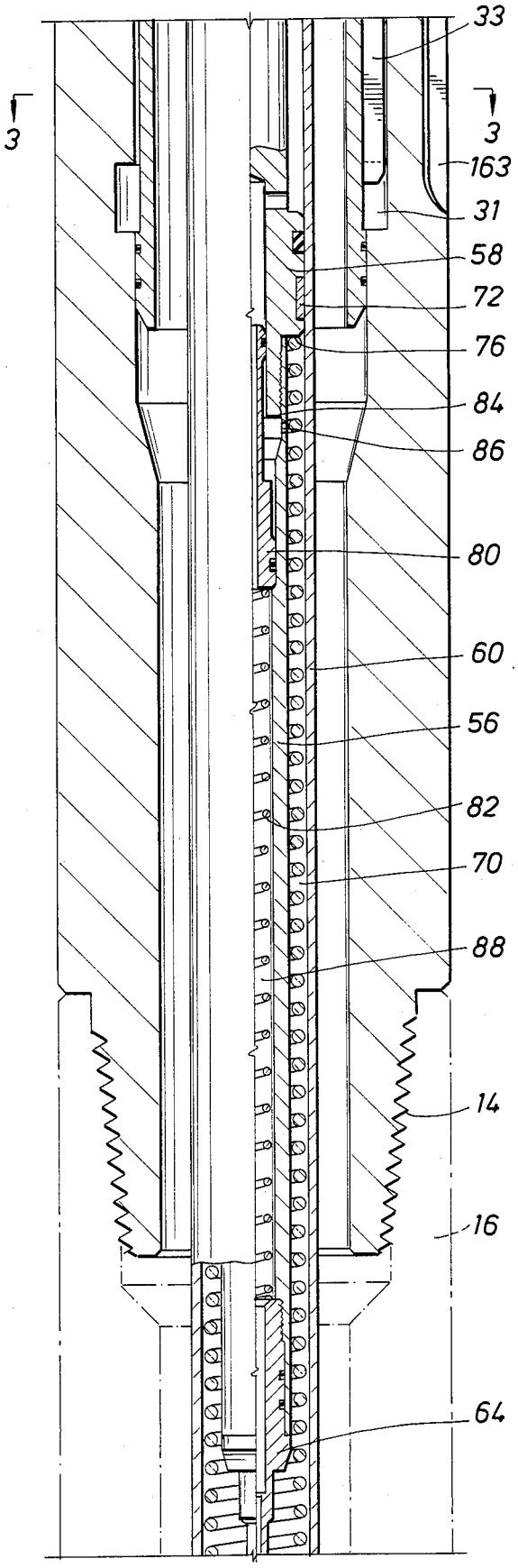

Attention is first directed to FIG. 1A and FIG. 1B which depict the top part of the preferred embodiment of the measuring while drilling tool. The top part of the tool includes the hollow tubular sub 10. The sub 10 is provided with a box connection 12 at its upper end and a pin connection 14 at its lower end for connection to a standard drill joint 16 shown in dotted lines in the drawings extending downward from the pin connection 14. The tool of the present invention is installed in a drill string which may include thousands of feet of drill pipe. The drill string is suspended from the surface in the well bore and connected to a mud flow line which delivers drilling fluid or mud through the drill string to the drill bit connected to the drill string at the lower end thereof. The measuring while drilling tool is typically located just above the drill bit for measuring the variables of interest, for example, borehole drift.

The sub 10 includes substantial wall thickness to provide adequate strength and an outer diameter which is substantially equal to the outer diameter of the drill string 16. A sleeve 18 is located within the upper portion of the sub 10. The sleeve 18 is axially hollow between a lower threaded end 20 and an upper end defined by an inwardly extending internal shoulder 22. Threadably connected to the lower end of sleeve 18 is a connector assembly including an axially hollow tubular member 24. The member 24 is externally threaded at its upper end for connection to the sleeve 18 at 20. The member 24 further includes an enlarged portion 26 immediately below it threaded end. The enlarged portion 26 provides a circumferential shoulder for engagement with an upwardly facing internal shoulder 28 formed in the sub 10.

Figure 2:
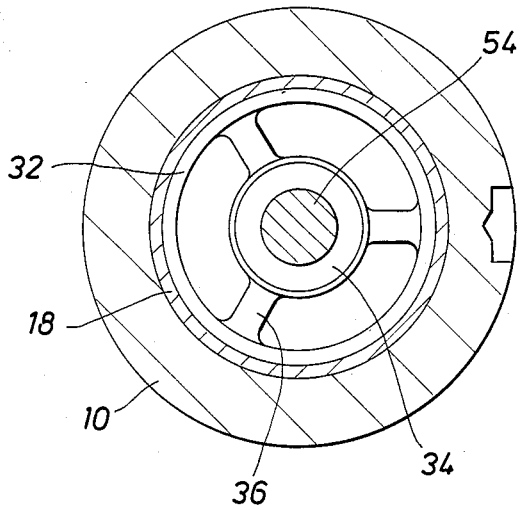
FIG. 2 is a sectional view taken along line 2—2 of FIG. 1A showing the mud flow path through the tool of the present invention.
Figure 3:
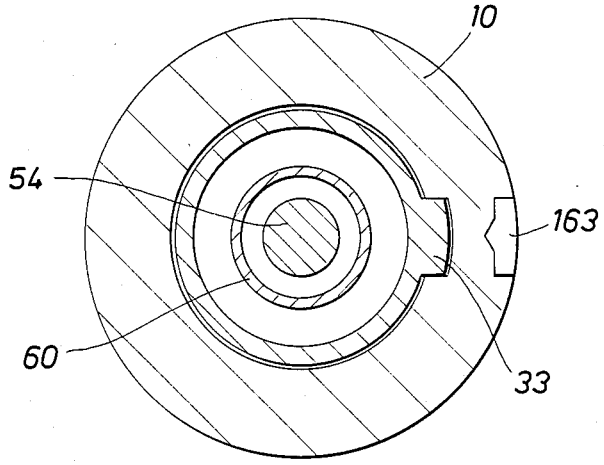
FIG. 3 is a sectional view taken along line 3—3 of FIG. 1B showing a means for aligning the components of the tool.

The connector assembly includes a collar 32 connected to an axially hollow member 34. The collar 32 is connected to the member 34 by a plurality of radially extending ribs 36 as best shown in FIG. 2. The ribs 36 define fluid passages through the collar 32 permitting drilling fluid to pass through the measuring while drilling tool via an annular passage 37. The lower edge of the collar 32 is formed with a plurality of teeth 38 for cooperative engagement with an adjustment ring 40 which is provided with a plurality of teeth about both ends. The adjustment ring 40 permits slight angular adjustment of the tool so that it may be properly aligned with a sensor package mounted at the lower end of the upper component or module. The adjustment ring 40 includes 36 teeth at its upper end and 37 teeth at its lower end permitting adjustment of approximately 0.25 degrees per tooth.

Pressure surges in the mud flow are formed by a plurality of constriction rings 42 which are securely mounted within the sleeve 18 between the collar 32 and shoulder 22. The constriction rings 42 are streamlined for maximum erosion resistance. Spacer rings 44 and 45 are located above and below the stack of constriction rings 42 insuring that the constriction rings 42 are tightly housed within the sleeve 18. The spacers 44 and 45 are profiled to provide a relatively smooth mud flow transition zone entering and exiting the constriction rings 42. The constriction rings 42 and spacers 44, 45 may be fabricated of any suitable erosion-resistant material; however, in the preferred embodiment, a special grade of tungsten carbide is utilized to form the constriction rings and spacers of the invention.

The sub 10 includes a short slot 30 formed in the interior wall thereof and an oppositely located axial slot 31 formed in the wall thereof. The slot 31 is sized to receive a key 33 integrally formed on the sleeve 24. The key 33 is utilized to align the measuring while drilling tool in a manner to be described in greater detail later herein.

In the drawings, FIG. 1A and FIG. 1B disclose the tubular sub 10 of the apparatus. It will be observed that the various components comprising the tubular sub 10 are very tightly housed therein and O-rings 46 and 48 are provided to form a fluid tight seal with the body of the sub 10. The constriction rings 42 are stacked tightly against each other so that fluid leakage is prevented even under high pressures which may be encountered in the well bore.

Figure 1C:
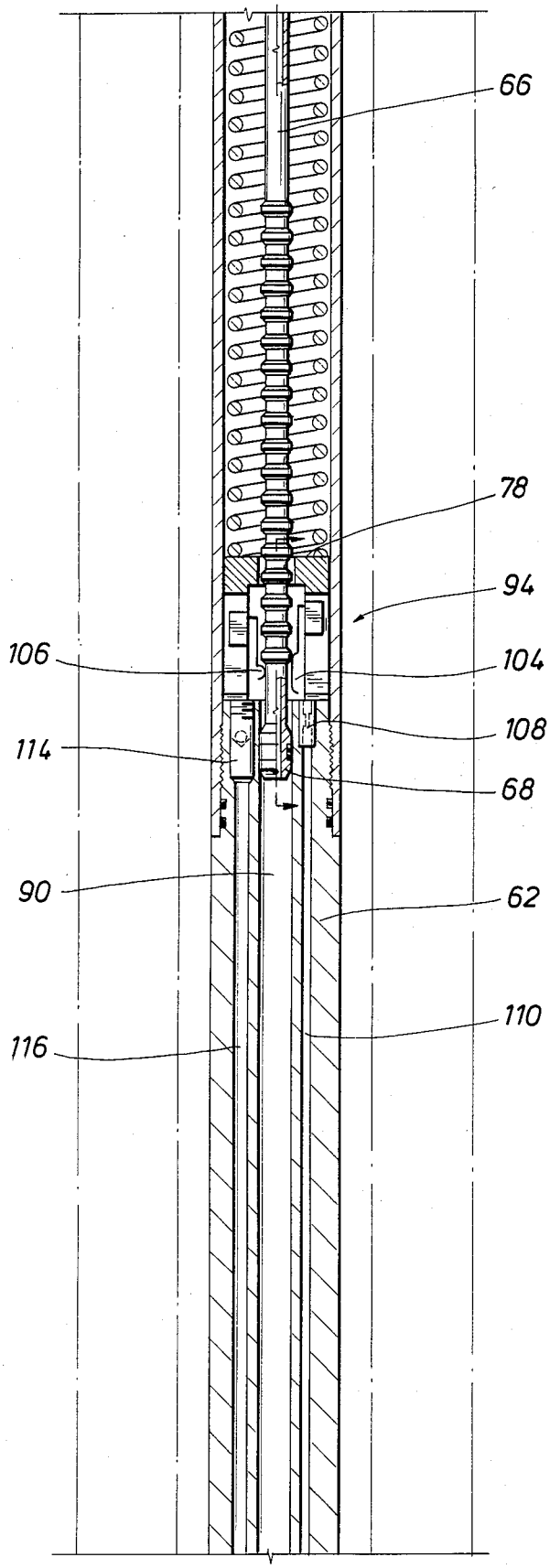

Referring now to FIGS. 1A–1C, the mud pulser sub is generally identified by the reference numeral 50. The pulser sub includes a streamlined plug 52 threadably joined to the upper end of a hollow, upstanding tubular member 54. The lower end of the tubular member 54 is externally threaded to receive an internal tubular sleeve 56. The lower end of the tubular member 54 includes an enlarged portion 58 in sealing contact with an outer elongate, axially hollow sleeve 60. The outer sleeve 60 is threadably connected at its upper end to the tubular member 34 and at its lower end to the valve manifold 62. The lower end of the internal tubular member 56 is closed by a plug member 64 which is threadably joined thereto. The plug member 64 includes an axially hollow rod portion 66 depending therefrom. The rod 66 terminates in a head 68 which is reciprocally received within the valve manifold 62. The lower portion of the rod 66 is formed with a plurality of ridges separated by valleys for sequentially contacting the switch mechanism to be described in greater detail later. The ridged portion of the rod 66 is formed by distinct peaks separated by valleys. It is not a threaded portion of the rod 66.

The internal sleeve 56 is concentrically mounted within the external sleeve 60 defining an annular cavity 70 therebetween. The annular cavity 70 is sealed at the upper end by several seals 72 about the enlarged portion 58 of the tubular member 54. The lower end of the annular cavity 72 is closed by the switch housing.

Positioned within the annular cavity 70 is a spring 74 which is compressed between the downwardly facing shoulder 76 of the enlarged portion 58 on the tubular member 54 and the upwardly facing shoulder 78 formed on the switch housing at the lower end of the annular cavity 70.

Referring again to FIG. 1B, it will be observed that a shuttle valve 80 is housed within the internal sleeve 56. The shuttle valve 80 is held in its upper-most position by a spring 82 positioned between the shuttle valve 80 and the plug 64. In its initial position, the shuttle valve 80 engages the downwardly facing edge 84 of the lower end of the tubular member 54, thereby closing the port 86 extending through the internal sleeve 56 and opening to the annular cavity 70. The annular cavity 70 is adapted to receive oil in it at increased pressure. The hollow mud pulser sub 50 defines a central cavity 88 which is in fluid communication with the low pressure cavity 90 in the valve manifold 62.

Figure 1D:
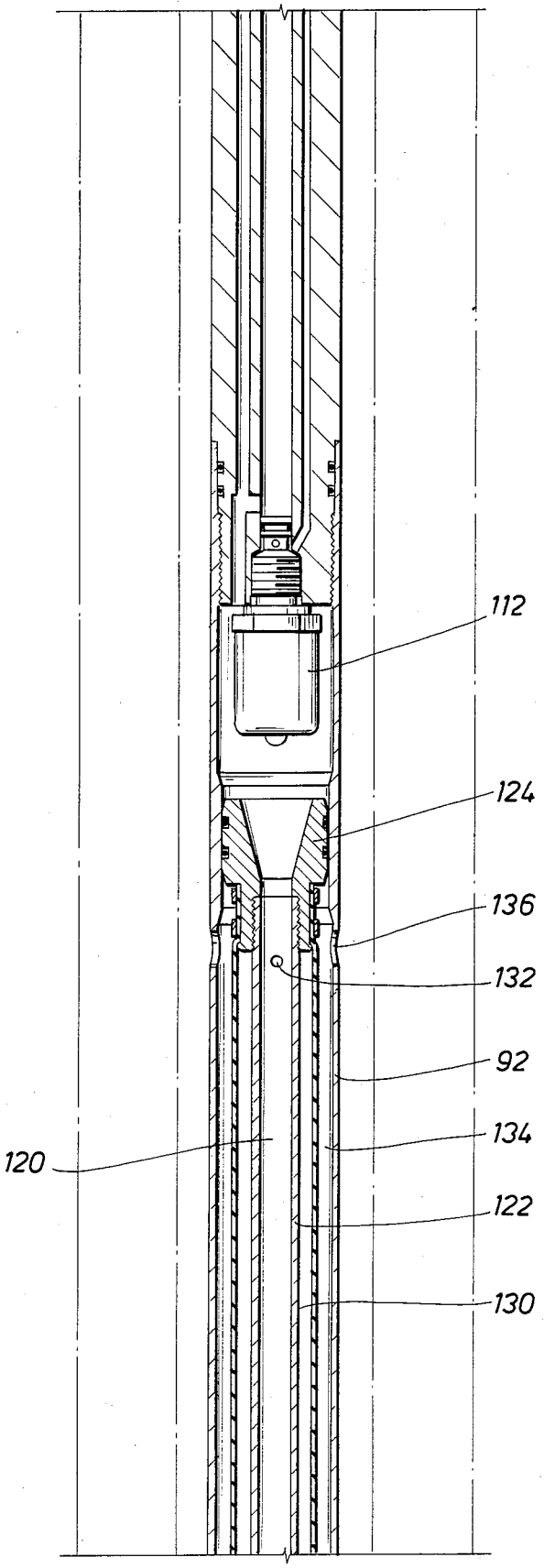
Figure 4:
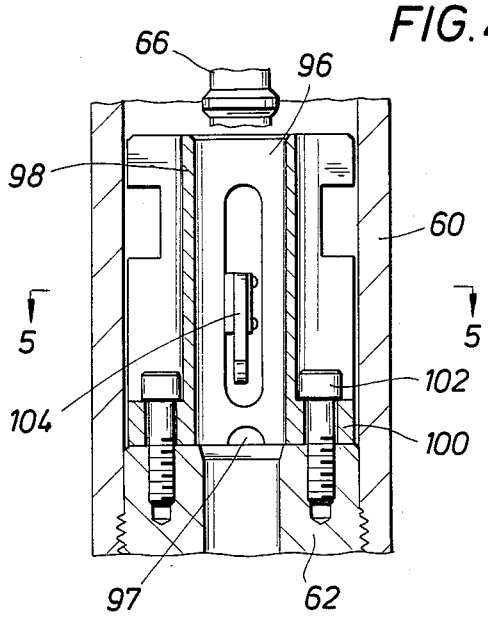
FIG. 4 is a partial sectional view of the switch housing of the present invention.
Figure 5:
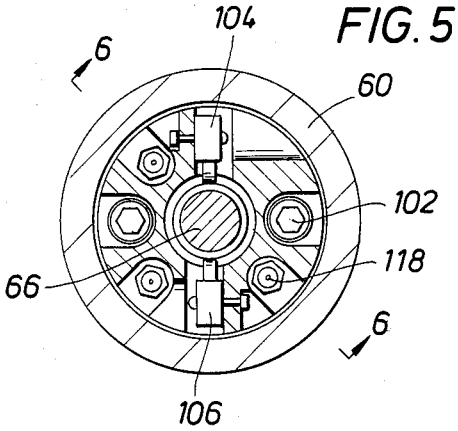
FIG. 5 is a sectional view taken along 5—5 of FIG. 4 showing the electrical connectors of the switch housing.

Referring now to FIGS. 1C and 1D, the valve manifold 62 is shown in greater detail. The valve manifold comprises a tubular body 62 threadably connected at its upper end to the external sleeve 60 and threadably connected at its lower end to the oil reservoir housing 92. The microswitch housing, generally identified by the reference numeral 94, is mounted to the upper end of the valve manifold body 62 as best shown in FIG. 4. The switch housing 94 compreses a substantially cylindrical member including an axial passage 96 extending therethrough. The axial passage 96 is defined by a slotted cylindrical wall 98 terminating at its lower end in a circumferential flange 100. A pair of bolts 102 extend through the flange 100 for threadably securing the switch housing 94 to the upper end of the valve manifold body 62.

Figure 6:
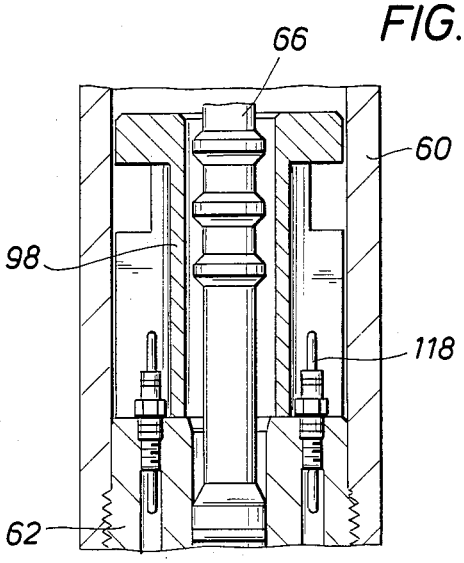
FIG. 6 is a sectional view taken along 6—6 of FIG. 5.

Referring again to FIG. 1C, it will be observed that the switch housing 94 houses two oppositely facing switches which engage the ridged portion of the rod 66 as it advances downwardly through the switch housing. The switch 104 is contacted first as the rod 66 moves downward. The switch 104 is the on/off switch which turns on the electrical system and initializes the tool for operation. The switch 104 is provided with a wide contact area so that it bridges the ridges of the rod 66 and remains on during the operation of the tool. The switch 106 switches on/off as the rod 66 advances downward. As the pulsar component 50 moves downward, oil in the annular cavity 70 is pressurized and forced through the switch housing 94. High pressure oil passes through the axial passage 96 and out the crescent opening 97 and is directed through a restrictor valve 108. The restrictor valve 108 permits the high pressure oil to flow smoothly out of the annular cavity 70. A high pressure passage 110 extends from the restrictor 108 to the solenoid 112. A one-way check valve 114 incorporated in the low pressure fluid path prevents high pressure fluid from exiting the switch housing to the low pressure passage 116. The solenoid valve 112 is electrically connected to the switch housing 94 and to the sensor module. For the sake of clarity in the drawings, the electrical wires are not shown. However, referring now to FIG. 6, electrical connectors 118 are shown threadably mounted to the valve manifold housing 62. The connectors may be of any suitable type, as for example, KEMLON connectors.

Figure 1E:
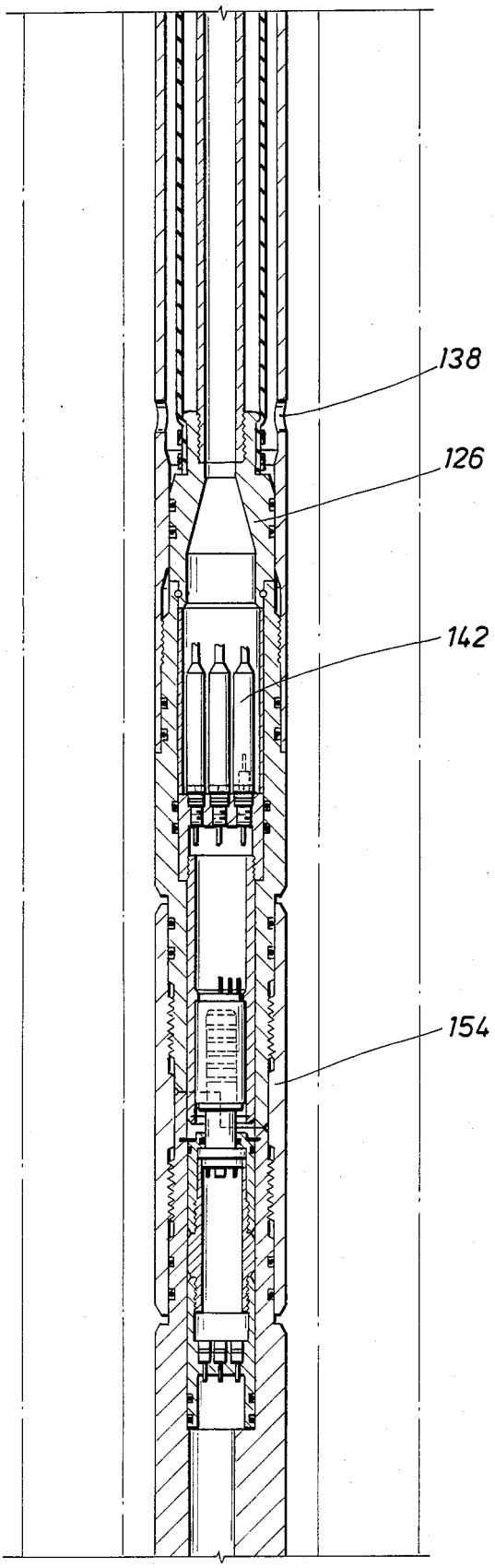

Attention is now directed to FIG. 1D and FIG. 1E, wherein the oil reservoir housing 92 is shown in greater detail. The housing 92 includes a central oil cavity 120 defined by a cylindrical tube 122. The cylindrical tube 122 is externally threaded at its upper end to be received by a mounting ring 124 and is externally threaded at its lower end to be received by a mounting ring 126. The tube 122 is completely enclosed by a flexible bladder 128 which is securely mounted at each end to the rings 124 and 126. The tube 122 and bladder 128 define an annular cavity 130 therebetween. Fluid communication is established between the interior of the tube 122 and the cavity 130 via a port 132 extending through the tube 122.

The tube 122 and bladder 128 are held in a fixed relationship within the reservoir housing 92. The tube 122 and bladder 128 are concentrically positioned within the housing 92 so that an annular space 134 is also defined between the bladder 128 and the surrounding housing 92. The annular cavity 134 is open to drilling fluid pressure via the ports 136 and 138 located at the upper and lower ends of the housing 92. Drilling fluid enters the upper end of the annular cavity 134 via the ports 136 and exits at the lower end thereof via the ports 138. Thus, the internal pressure of the tool is maintained at the mud flow pressure in the borehole.

The lower end of the housing 92 is closed by a connector 140. The connector 140 houses the electrical connectors 142 and wires extending from the switch housing 94 for connection to the sensor module. The electrical connectors 142 are insulated so that they will not be contaminated by the oil in the internal cavity 120. The lower end of the connector 140 is defined by a socket-type recess for receiving a prong-type band connector (shown in dotted line in FIG. 1E).

Figure 7:
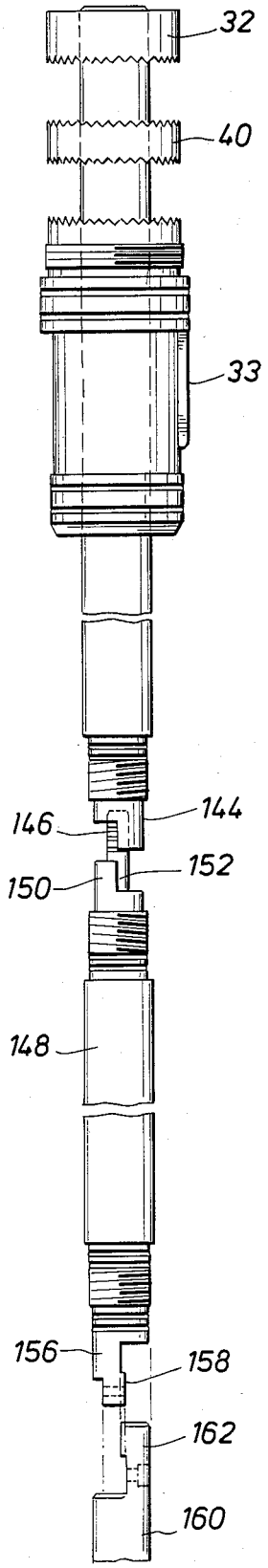
FIG. 7 is a partial, exploded view showing alignment of the components of the tool of the present invention.

To this point, the upper portion of the measuring while drilling tool of the present invention has been described. It is understood that all connectors have been made up tight and all fluid cavities have been sealed by seals to prevent leakage. To enable proper alignment of the three modules making up the tool of the invention, the lower end of the connector 140 incorporates a downwardly extending semicircular neck 144. The neck 144 includes a flat surface 146. The stabilizer component 148 is provided with a matching neck 150 and flat cooperating surface 152 thereon, as best shown in FIG. 7. The two components are joined together by a tubular connector 154 which is provided with left hand threads at one end and right hand threads at the other so that both components are drawn towards each other until they are completely made up as shown in FIG. 1E.

Referring again to FIG. 7, it will be observed that the stabilizer component 148 is a machined one piece component which is provided with a second semicircular neck 156 extending from the lower end thereof. The neck 156 is provided with a flat surface 158 which lies in a plane parallel to the flat surfaces 146 and 152. Once all connections in the upper portion of the tool are tightly made, the flat surface 158 may be aligned to lie in a plane parallel to the plane of the key 33. This is accomplished by rotating the collar 32 and thereby the stabilizer 148 to visually align the surface 158 with the key 33. Fine adjustment is then made by rotating the adjustment ring 40 so that the key 33 and the flat surface 58 are in substantial alignment. Once aligned in this manner, the sensor package housing 160 is bolted to the neck 156 of the stabilizer 148. The sensor package housing is provided with a mating neck 162 insuring that the sensor package will be properly aligned with the upper portion of the tool. An external V-grooved slot 163 on the tubular member 10 in substantial alignment with the key 33 provides a visual indication of the orientation of the sensor module insuring that it is properly oriented.

Figure 1F:
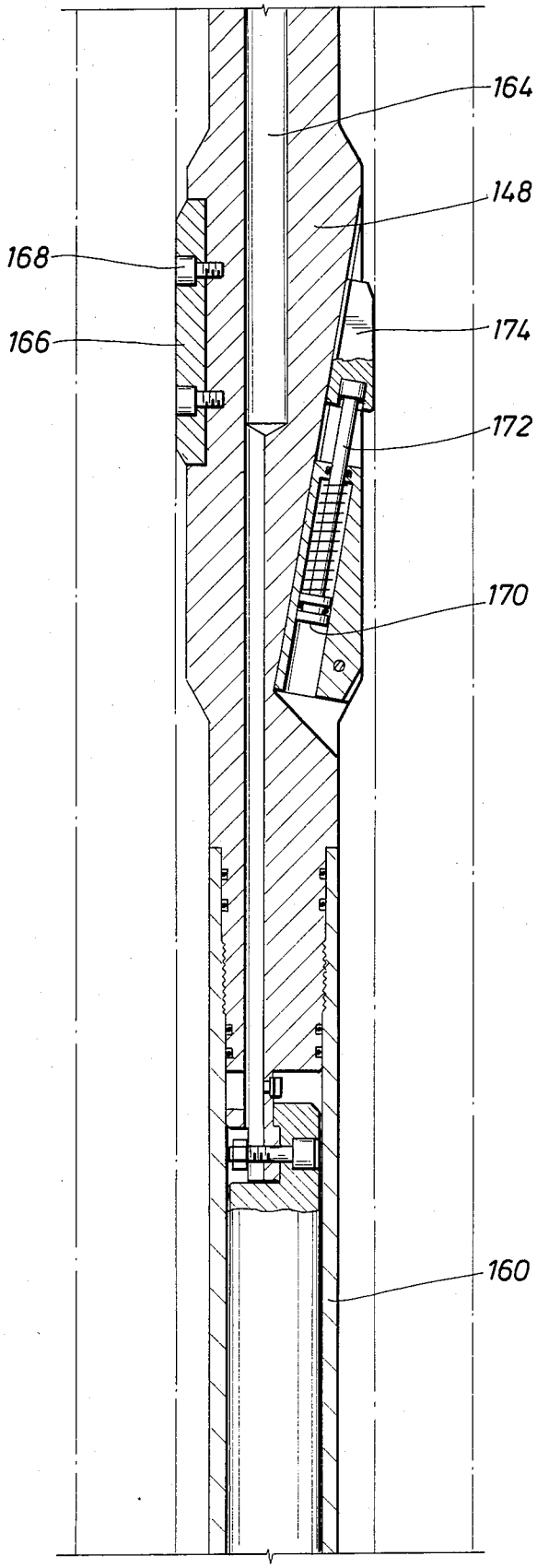

Referring now to FIG. 1F, the stabilizer 148 is shown. The stabilizer 148 includes an axial passage 164 permitting the electrical connectors to be extended to the sensor module housing 160. The stabilizer 148 includes a shoe 166 which is securely fixed thereon by bolts 168. Opposite the shoe 166, the stabilizer 148 incorporates a hydrostatic lock including a piston exposed to borehole pressure at the piston surface 170. The other end of the piston rod 172 is connected to a wedge member 174 which is forced outwardly upon an increase in pressure, thereby tightly securing the measuring while drilling tool to the surrounding drill pipe 16.

The sensor package of the tool of the invention is housed within the sensor housing 160. The sensor housing 160 is internally threaded at the upper end to receive the externally threaded end of the stabilizer body 148 and is internally threaded at its lower end to receive the externally threaded end of the operating mode module generally indentified by the reference numeral 180. The sensor package of the tool of the present invention is of a type commercially available which may be encoded to transmit the value of the downhole variables of interest.

Figure 1G:
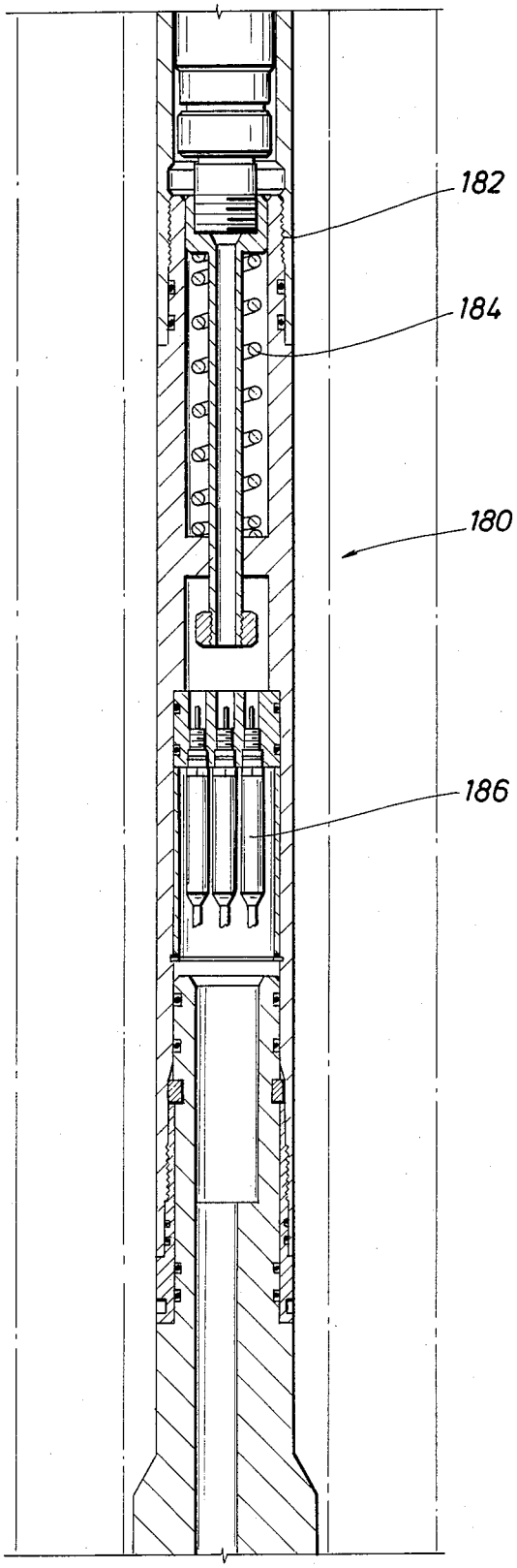
Figure 1H:
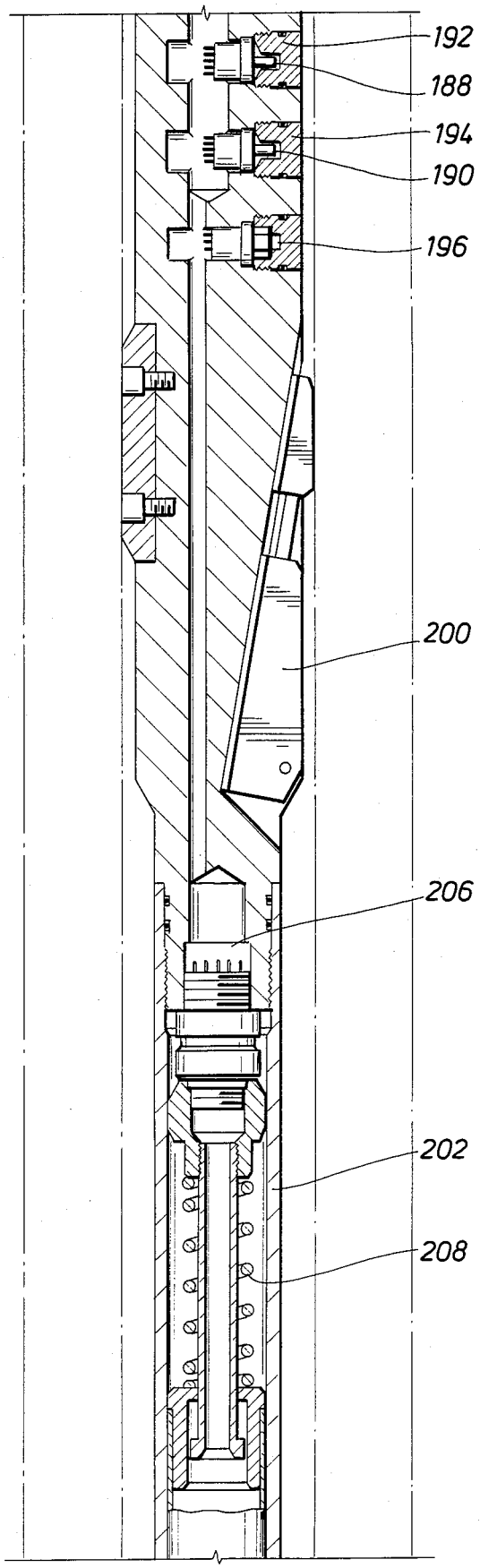
Figure 11:
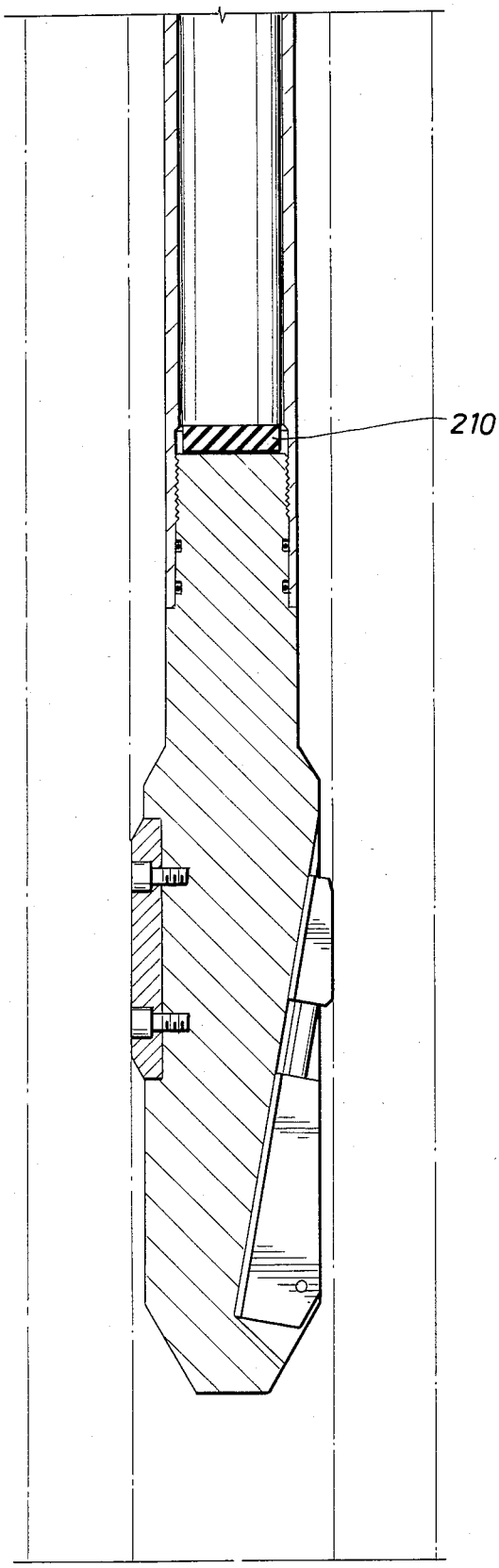

The operating mode module 180 is threaded to the lower end of the sensor package housing at 182, as best shown in FIG. 1G. The module 180 is provided with a plug-type connector received in a socket receptacle in the lower end of the sensor package housing 160. A spring 184 aids in maintaining the connection, even under extreme loads. KEMLON connectors 186 are incorporated in the module 180, the electrical wires extending therethrough to the selectable switches 188 and 190. The switches 188 and 190 are protected from the drilling fluid by externally threaded plugs which are received in the internally threaded ports 192 and 194. The switches 188 and 190 are selectively set prior to placing the tool in the borehole. The switches 188 and 190 are four position switches and may be set for a selected mode or time interval, as for example, the survey mode or steering mode. The switch 190 may be set for a specific data rate to minimize the effects of pulse attenuation as depth increases. The switch 196 permits the tool to be connected to a test unit for a quick operations check before running the tool in the borehole. The check verifies that the system is at full operating capability. This middle portion of the tool is firmly fixed in the drill pipe 16 by incorporating a second shoe 198 and hydrostatic lock 200 to lock the tool to the drill pipe.

The lower third of the tool comprises a battery package housed within a tubular housing 202. The tubular housing 202 is threadable secured at its upper end to the lower end of the operating mode module 180 and at its lower end to a bottom located stabilizer 204. The battery package of the tool is electrically connected to the sensor package via a prong and socket connection shown at 206. A spring 208 insures that the electrical connection is maintained in the violent environment near the drill bit. An elastomeric pad 210 located at the lower end of the battery package functions as a shock absorber to reduce the risk of damage to the battery package.

In operation, the measuring while drilling tool of the present invention is incorporated in a drill string near the drill bit. The tool is equipped with a sensor package which forms electrical output signals to operate a solenoid valve and thereby cause pressure fluctuations in the mud stream which may be measured by surface equipment. The solenoid valve is operated for a sufficient time to give the proper value of the variable of interest. In the present disclosure, this is accomplished by forcing the mud pulser sub 50 through a series of constriction rings 42 to create the mud flow pressure pulses.

Initially, the tool is initialized by shutting down the mud pumps for a short period of time, perhaps 20 seconds. The mud pumps are then actuated to overcome the upward force of the spring 74 and the resistance of the oil in the annular cavity 70. A quick jolt enables the pulser sub 50 to drop slightly by forcing the shuttle valve 80 downward to open the port 86 and thereby permit high pressure oil to enter the small cavity 212 shown in FIG. 1B. Upon downward movement of the pulser sub 50, the switch 104 is engaged and the electronic system of the tool is turned on an initialized. The mode of operation of the tool has been preselected so that once the tool is turned on, the sensor package operates the solenoid valve in the operational sequence to display the value of the variable of interest at the surface.

The surface equipment measures the time duration of the pressure pulses in the mud. The pulser sub 50 advances downward through a complete sequence so that the plug 52 passes through all of the constriction rings 42. All data is transmitted to the surface equipment twice for verification purposes. Initially, a calibration time is transmitted. Thereafter, the value of the desired variable is transmitted as series of integers. For example, in the survey mode, the tool will transmit three integers for drift and three integers for azimuth. The drift will be transmitted in tens, units, and tenths. For example, if the drift is 32.4 degrees, the first integer to appear is a "3", the second is a "2" and the third is a "4". Azimuth will appear as hundreds, tens and units. For example, 125 degrees would appear first as "1", second as "2", and third as "5". The measurement parameters of the system for drift is 0 to 90 degrees and for azimuth is 0 to 360 degrees. The data is transmitted twice for verification and to insure the highest degree of accuracy. The last signal that may be transmitted is any other variable of interest as, for example, battery status, temperature or other measurable downhole variable.

In the operational sequence, as the pulser sub 50 is forced downward, the spring 74 is compressed and fluid in the annular cavity 74 is compressed and forced through the restrictor 108 as the enlarged portion 58 of the tubular member 54 is forced downward. The solenoid 112 operated by the sensor module permits the pulser sub 50 to descend at an appropriate rate to create the pressure pulse duration required for encoding the value of the measured variable. The switch 104 is on during the entire sequence, whereas the switch 106 traces the peaks and valleys of the rod 66. The peaks and valleys on the rod 66 correspond to the peaks and valleys of the constriction rings 42 enabling the sensor package to transmit the correct integer in the three digit transmission which makes up the variable of interest. At the end of the transmission sequence, the mud pumps are turned off permitting the pulser sub 50 to rise upon return of the spring 74 to its original position. As the sub 50 rises, oil is permitted into the annular cavity 70 via the check valve 114. The upward travel of the sub 50 is limited upon engagement of the shoulder 55, which is integrally formed on the tubular member 54 with the downwardly facing shoulder 35 on the tubular member 34. The transmission time is calculate as a function of $T=T_1+NT_2$, wherein $T_1$ equals calibration time (seconds), $T_2$ equals seconds (integer), and N equals an integer. $T_1$ is calibrated at the beginning of a sequence and $T_2$ is selected by setting the switch 190 prior to lowering the tool into the borehole. Therefore, the apparatus of the invention provides a direct reading of N so that a direct number transfer of the value of the sought variable is transmitted to the surface equipment.

While the foregoing is directed to the preferred embodiments of the present invention, other and further embodiments of the invention may be devised without departing from the basic scope thereof, and the scope thereof is determined by the claims which follow.

What is claimed is:

1. A measuring while drilling mud-pulse telemetry system for use while drilling a borehold in the earth, the system comprising:

(a) an elongate, hollow tubular member adapted to be connected in a drill string;

(b) constriction means in said tubular member for creating a sequence of pressure pulses in drilling fluid circulated through the drill string;

(c) a mud pulser sub mounted within said hollow tubular member and extending into a length a drill pipe in the drill string for producing pressure pulses in the drilling fluid, said mud pulser sub including a rod member having a plurality of spaced peaks and valleys formed along a lower portion of said rod member;

(d) a closed hydraulic fluid system for modulating downward movement of said rod member of said mud pulser sub;

(e) sensor means responsive to a variable of interest in the borehole for forming a signal indicative of a value of the variable of interest;

(f) switch means operatively connected to said sensor means, said switch means being engageable with said lower portion of said mud pulser sub and being actuable upon downward movement of said rod member of said mud pulser sub; and (g) battery means operatively connected to said sensor means for operation thereof.

2. The apparatus of claim 1 wherein said mud pulser sub includes a spring biased shuttle valve permitting said mud pulser sub to move to an initial shift position.

3. The apparatus of claim 1 wherein said mud pulser sub is biased to an initial position by spring means.

4. The apparatus of claim 1 wherein said constriction means comprises at least two erosion resistant rings stacked within said hollow tubular member for varying the mud flow permitted through said constriction means upon reciprocation of said mud pulser sub.

5. The apparatus of claim 1 wherein said hollow tubular member includes an elongate slot formed therein for receiving a matching elongate key integrally formed on said mud pulser sub, said slot and said key cooperating to enable alignment of said hollow tubular member with said sensor means.

6. The apparatus of claim 5 including an adjustment ring permitting minute angualr adjustment of said hollow tubular member relative to said sensor means.

* * * * *